US007093732B1

(12) United States Patent
Makio et al.

(10) Patent No.: US 7,093,732 B1
(45) Date of Patent: Aug. 22, 2006

(54) CRT FUNNEL WITH POSITIONING REFERENCE PORTIONS

(75) Inventors: Hajime Makio, Hikone (JP); Masaya Kyono, Nagahama (JP); Shigeyoshi Ito, Nagahama (JP)

(73) Assignee: Nippon Electric Glass Co., Ltd., Otsu (JP)

( * ) Notice: Subject to any disclaimer, the term of this patent is extended or adjusted under 35 U.S.C. 154(b) by 832 days.

(21) Appl. No.: 09/787,953

(22) PCT Filed: Jun. 2, 2000

(86) PCT No.: PCT/JP00/03585

§ 371 (c)(1),
(2), (4) Date: Mar. 23, 2001

(87) PCT Pub. No.: WO01/08194

PCT Pub. Date: Feb. 1, 2001

(30) Foreign Application Priority Data

Jul. 27, 1999 (JP) ..... 11-211517

(51) Int. Cl.
*H01J 29/86* (2006.01)

(52) U.S. Cl. ..... 220/2.1 A; 313/477 R

(58) Field of Classification Search ..... 313/477 R; 220/2.1 A, 2.3 A, 2.2; 348/818, 821, 823, 348/825, 836; 445/8, 45; 65/68, 305, 323
See application file for complete search history.

(56) References Cited

U.S. PATENT DOCUMENTS

| | | | | |
|---|---|---|---|---|
| 5,865,884 A | * | 2/1999 | Segawa et al. | 106/243 |
| 6,427,490 B1 | | 8/2002 | Bordt et al. | 65/68 |

FOREIGN PATENT DOCUMENTS

| | | |
|---|---|---|
| DE | 298 04 371 U1 | 7/1998 |
| JP | 43-18122 | 7/1968 |
| JP | 51-3326 | 2/1976 |
| JP | 53-82793 | 6/1978 |
| JP | 5-131864 | 10/1979 |
| JP | 54-131864 | 10/1979 |
| JP | 55-35426 | 3/1980 |
| JP | 55-50528 | 4/1980 |
| JP | 60-33746 | 3/1985 |
| JP | 63-10447 | 1/1988 |
| JP | 01-239730 | 9/1989 |
| JP | 4-21238 | 5/1992 |
| JP | 07-037529 | 2/1995 |
| JP | 8-111189 | 4/1996 |
| JP | 9-245646 | 9/1997 |
| JP | 10-340687 | 12/1998 |

* cited by examiner

*Primary Examiner*—Ashok Patel
(74) *Attorney, Agent, or Firm*—Westerman, Hattori, Daniels & Adrian, LLP

(57) ABSTRACT

Upper end edges (7*a*, 7*b*, 7*c*) of positioning reference portions (5*a*, 5*b*, 5*c*) to be formed on outer walls of a funnel (1) for cathode ray tube are formed at distances (downwardly) toward a narrow open end (3) of the funnel from a maximum profile line (4) formed in the vicinity of a wide open end (2) by mold matching of forming mold at the time of press molding, thereby suppressing molding defects such as deficiency and wrinkle resulting from that glass is not completely filled, which are likely to occur in reference surfaces (6*a*, 6*b*, 6*c*) of the positioning reference portions, and eliminating occurrences of small cracks caused by concentration of heat stress, which are likely to occur in the upper end edges (7*a*, 7*b*, 7*c*) of the reference portions, to improve the productivity of the funnel.

4 Claims, 4 Drawing Sheets

CRT FUNNEL WITH POSITIONING REFERENCE PORTIONS

FIELD OF THE INVENTION

The present invention relates to a funnel which is a constituent of a glass bulb for cathode ray tube.

BACKGROUND OF THE INVENTION

A glass bulb for cathode ray tube usually comprises a front panel on which an image is to be displayed, a funnel disposed behind the panel and sealed with the panel, on outside of which a deflection yoke is to be attached, and a neck welded with the funnel for accommodating an electron gun therein.

The panel on which an image is to be displayed has a generally rectangular shape, and also a wide open end of the funnel sealed with the panel has a generally rectangular shape similar to that of the panel. Further, the neck in which an electron gun is to be accommodated has a cylindrical shape, and also a narrow open end of the funnel welded with the neck has a similar circular shape.

In order to allow a cathode ray tube to display a proper image without displacement of color, it is important to assemble it while precisely positioning the respective axes of the panel, the funnel and the neck with respect to the tube axis of the glass bulb. In order to accomplish this, on outer walls of sides of the funnel which are adjacent to each other is provided a plurality of positioning reference portions which are to be used with being abutted to a jig at the time of sealing with the panel (See, for example, Japanese Unexamined Patent Publications JP-A 63-10447 (SHO-63, 1988) and JP-A 9-245646 (HEI-9, 1997)), and reference surfaces of the positioning reference portions are formed at a predetermined distance from the axis of the funnel.

FIG. 6 is a perspective view of a conventional funnel for cathode ray tube disclosed in the above-mentioned publications and the like, and FIG. 7 is a section view of essential part of a positioning reference portion thereof. In each drawing, the reference numeral 1 denotes a funnel, the reference numeral 2 denotes a wide open end, the reference numeral 3 denotes a narrow open end, the reference numeral 4 denotes a maximum profile line, the reference numerals 5*a*, 5*b*, 5*c* denote positioning reference portions, the reference numerals 6*a*, 6*b*, 6*c* denote reference surfaces of the respective reference portions, and the reference numerals 7*a*, 7*b*, 7*c* denote upper end edges of the respective reference portions.

Conventionally, these upper end edges 7*a*, 7*b*, 7*c* of the positioning reference portions of the funnel for cathode ray tube are formed at positions overlapping with the maximum profile line 4 formed by mold matching of a forming mold 10 and a shell mold 11.

In other words, as shown in FIG. 8, the aforementioned funnel 1 is generally press-molded by supplying a forming mold consisting of a bottom mold 10 and a shell mold 11 with a molten glass gob of high temperature, and then causing a plunger mold 12 to move down so as to extend the molten glass gob by pressing. After molding, the plunger mold 12 is moved up, and after removing the shell mold 11, the funnel 1 is removed from a bottom mold 10.

Molding surfaces for the positioning reference portions 5*a*, 5*b*, 5*c* are formed as recess portions in a bottom mold 10, and formed in the uppermost part of a bottom mold 10 in a state that upper portions thereof are free due to the fact that the funnel 1 will be removed from the bottom mold 10 after press molding. Consequently, the upper end edges 7*a*, 7*b*, 7*c* of the positioning reference portions are located at the positions that overlap with the maximum profile line 4 formed by mold matching of the bottom mold 10 and the shell mold 11.

As described above, the upper end edge 7*a* of the positioning reference portion 5*a* (ditto for 5*b*, 5*c*) of the conventional funnel overlap with the maximum profile line 4 formed in the vicinity of the wide open end 2 of the funnel 1 as a result of mold matching of forming mold consisting of the bottom mold 10 and the shell mold 11, and moreover, the positioning reference portion 5*a* is formed into a shape projecting to the outside from the maximum profile line 4.

For this reason, during press molding of the funnel, the positioning reference portion 5*a* is to be formed of glass of which temperature has slightly decreased in the substantially final stage of molding where the molten glass gob supplied to the bottom mold 10 is extended by pressing toward the neighborhood of the wide open end formed by the shell mold 11, and moreover the positioning reference portion 5*a* has a shape projecting to the outside from the outer wall of the funnel, with the result that not-filled (a defect that the positioning reference portion 5*a* is not completely filled with the glass) or wrinkling was likely to occur in the corresponding reference surface 6*a*.

Furthermore, chipping sometimes occurs in the corner between the reference surface 6*a* of the positioning reference portion 5*a* and the upper end edge 7*a* because of flash of glass formed by mold matching of forming mold consisting of the shell mold 11 and the bottom mold 10. Additionally, in the positioning reference portion 5*a* of which wall thickness suddenly changes, small cracking caused by concentration of heat stress at the upper end edge 7*a* used to cause a breakage on the entire funnel.

It is therefore an object of the invention to suppress molding defects such as not-filled, wrinkling and chipping in a positioning reference portion formed on an outer wall of a funnel for cathode ray tube, and avoid occurrence of small cracking caused by concentration of heat stress generated at an upper end edge of the reference portion, thereby improving the productivity of the funnel.

SUMMARY OF THE INVENTION

The present invention was made to solve the above-mentioned problems, and provides a funnel for cathode ray tube comprising: a wide open end of generally rectangular shape; a maximum profile line formed in the vicinity of the wide open end by mold matching of forming molds; a narrow open end of generally circular shape; and a positioning reference portion disposed on an outer wall thereof used for sealing with a panel for cathode ray tube, wherein an upper end edge of the positioning reference portion is formed at a distance from the maximum profile line toward the narrow open end.

Furthermore, the present invention is characterized in that when a distance in the axial direction from the maximum profile line to the upper end edge of the positioning reference portion is defined as h (mm), $3 \leqq h$ is satisfied. Setting h at more than or equal to 3 mm is desirable from the viewpoint of further suppressing the problems of not-filled, wrinkling, chipping and the like.

Furthermore, the present invention is characterized in that when a distance in the axial direction from the maximum profile line to the upper end edge of the positioning reference portion is defined as h (mm), and when a distance in the axial direction from the wide open end to the narrow open end is defined as H (mm), $h \leqq 0.2H$ is satisfied. If $h \leqq 0.2H$, it becomes difficult to hold the funnel in a stable manner at the time of sealing the panel while the wide open end of the funnel being directed upward and a jig is abutted to the positioning reference surface, because the positioning reference portion is close to the center of gravity of the funnel or located in a lower position than the center of gravity of the funnel.

Furthermore, the present invention is characterized in that a reference surface of the positioning reference portion is formed inside the maximum profile line when viewed from the axial direction.

According to the present invention, since the positioning reference portion is formed at a distance from the maximum profile line of the funnel toward the narrow open end, the upper end edge of the positioning reference portion does not overlap with the maximum profile line formed by mold matching not as in the case of conventional one, and the positioning reference portion is formed at a lower position before the temperature of glass decreases, it is possible to suppress molding defects such as not-filled, wrinkling, chipping and the like which might occur in the reference portion.

Furthermore, by setting h to satisfy $3 \leqq h$, the positioning reference portion is formed in the stage sufficiently earlier than that the molten glass gob has extended by pressing to reach the upper wide open end, with the result that it is possible to further suppress the occurrence of molding defects such as not-filled, wrinkling, chipping and the like.

On the other hand, by setting h and H to satisfy $h \leqq 0.2H$, at the time of sealing the funnel with the panel while the wide open end of the funnel is directed upward and a jig is abutted to the positioning reference surface, it is possible to hold the funnel in a stable manner at a higher position than the center of gravity of the funnel.

According to the present invention, by forming the positioning reference portion at the position inside the maximum profile line toward the axis of the funnel, it is possible to reduce the amount by which the reference surface thereof projects from the outer wall of the funnel vertically outward the axis of the funnel, to relieve the change in wall thickness in the portion in question because the wall thickness of the positioning reference portion gradually increases downwardly from the upper end edge thereof, allowing production of a funnel for cathode ray tube which will not cause occurrence of a small crack from the upper end edge due to concentration of heat stress as described above, and enabling simple handling by eliminating the portion projected to the outside from the maximum profile line.

DETAILED DESCRIPTION OF THE PREFERRED EMBODIMENTS

Figure 1:
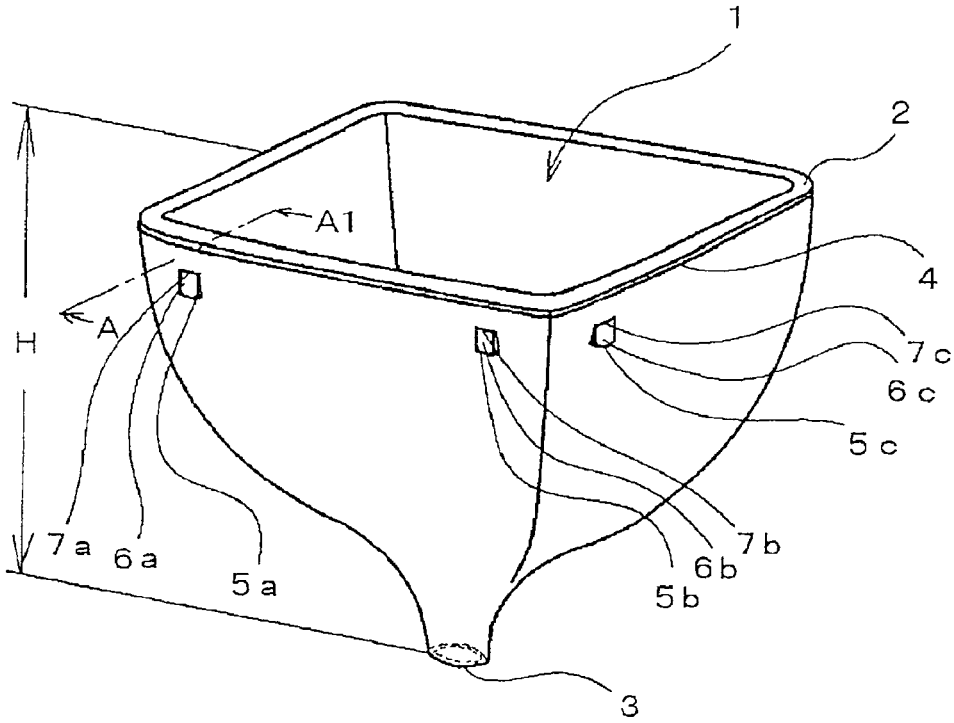
FIG. 1 is a perspective view showing a funnel for cathode ray tube according to the present invention.
Figure 2:
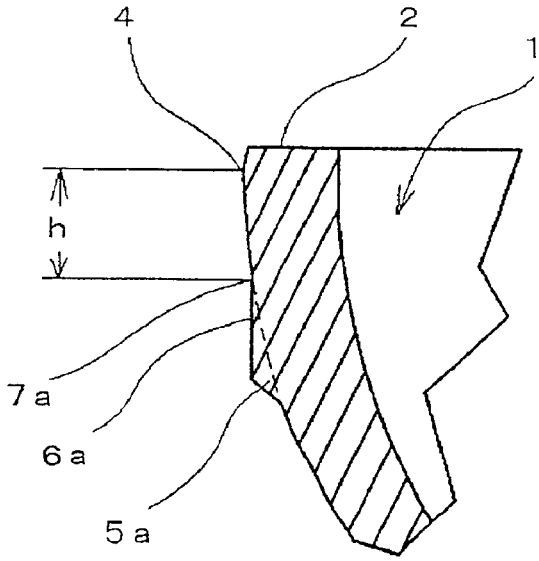
FIG. 2 is a section view of essential part along the line A-A1 of FIG. 1, showing a positioning reference portion of the funnel for cathode ray tube according to the present invention.
Figure 3:
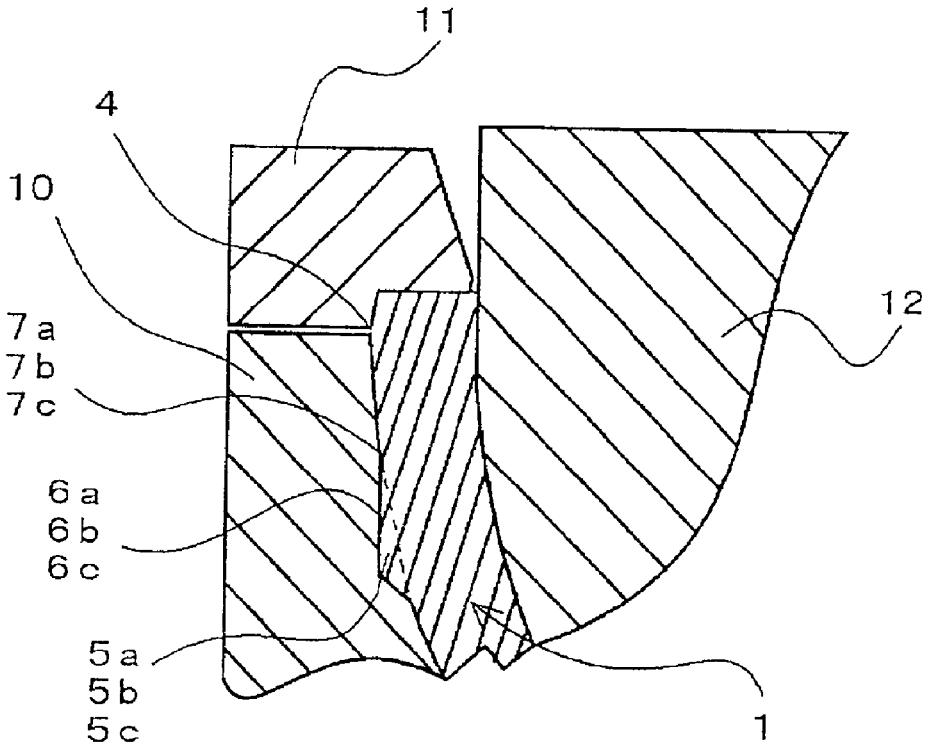
FIG. 3 is a section view of essential part of a mold configuration used for press molding of the funnel for cathode ray tube according to the present invention.
Figure 6:
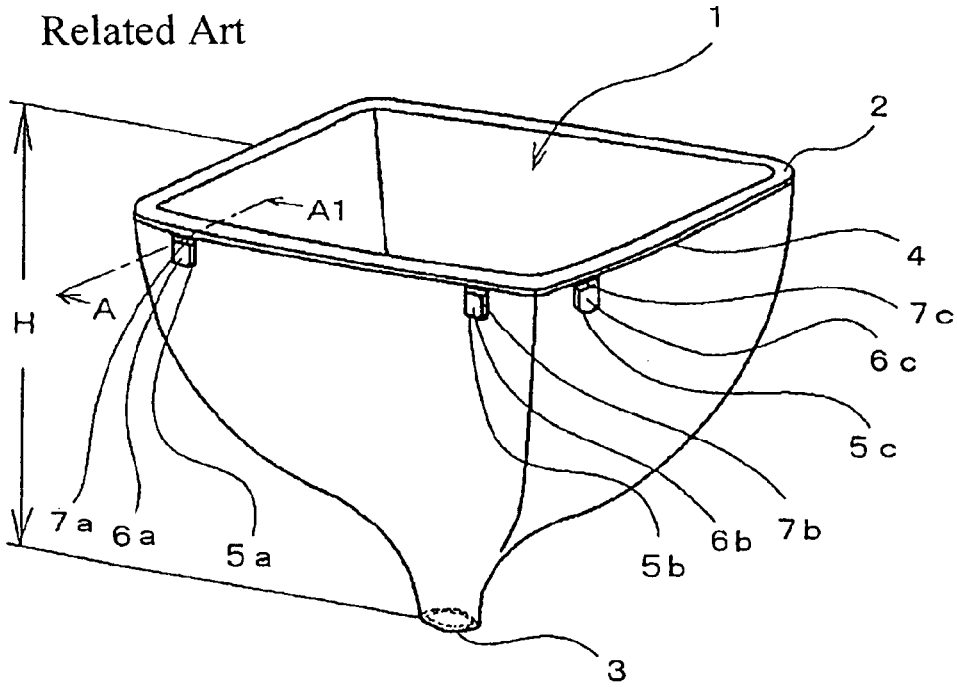
Fig.6 Related Art
FIG. 6 is a perspective view of a conventional funnel for cathode ray tube.
Figure 7:
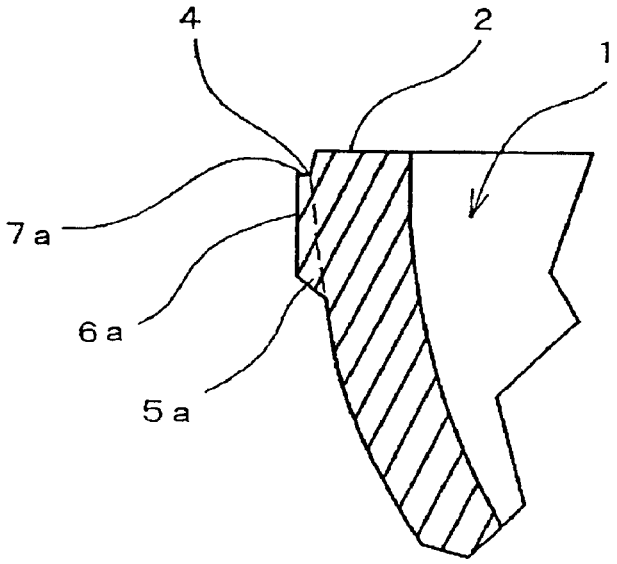
Fig.7 Related Art
FIG. 7 is a section view of essential part along the line A-A1 of FIG. 6, showing a positioning reference portion of the conventional funnel for cathode ray tube.
Figure 8:
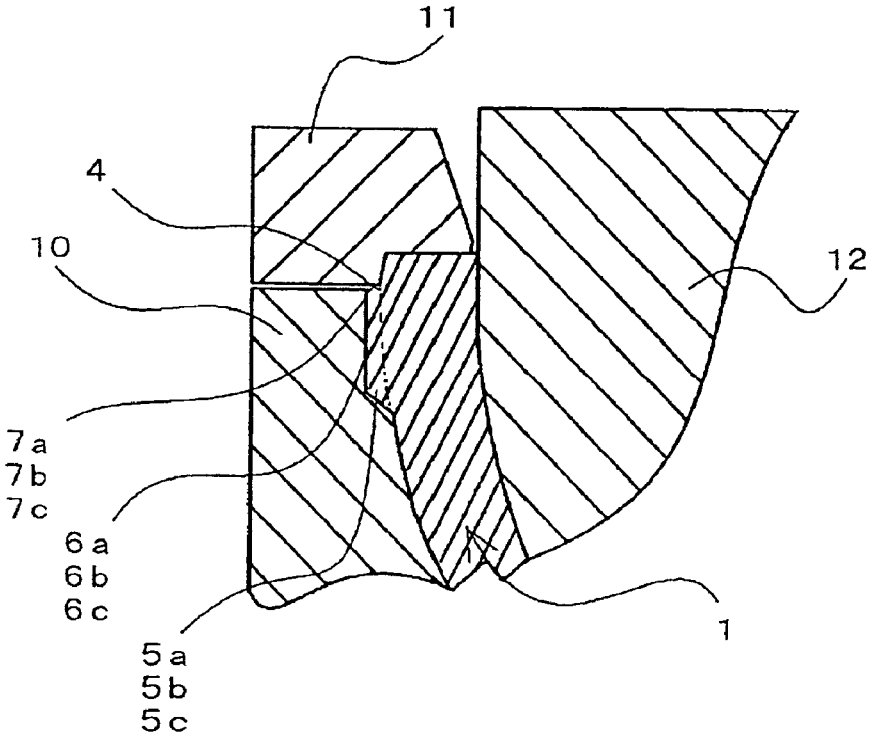
Fig.8 Related Art
FIG. 8 is a partial section view of a mold configuration used for press molding of the conventional funnel for cathode ray tube.

In the following, an embodiment of a funnel for cathode ray tube according to the present invention will be explained with reference to FIGS. 1, 2 and 3. FIGS. 1 and 2 show a funnel for cathode ray tube according to the present invention, and FIG. 3 shows a mold configuration used for press molding of the funnel according to the present invention. In FIGS. 1 to 3, the same portions and the equivalent portions as described above with regard to FIGS. 6, 7 and 8 are denoted by the same reference numerals.

In FIGS. 1 and 2, the funnel 1 has a plurality of positioning reference portions 5*a*, 5*b*, 5*c* on outer walls of the neighboring sides, and in the case of a funnel for cathode ray tube of 29 inches, for example, a distance in the axial direction H from a wide open end 2 to a narrow open end 3 is 353 mm, and a distance in the axial direction h from a maximum profile line 4 to upper end edges 7*a*, 7*b*, 7*c* of the positioning reference portions 5*a*, 5*b*, 5*c* is 12 mm. Furthermore, positioning reference surfaces 6*a*, 6*b*, 6*c* are formed at positions (inside) distanced approximately 1 mm from the maximum profile line 4 on the axial side.

As shown in FIG. 3, the funnel 1 according to the present invention is produced by means of a press forming mold configuration consisting of a bottom mold 10, a shell mold 11 and a plunger mold 12 as same as the conventional case, however molding surfaces for the positioning reference portions 5*a*, 5*b*, 5*c* formed in the bottom mold 10 are provided at lower positions than the upper end of the bottom mold 10 forming the maximum profile line 4 of the funnel with being distanced therefrom.

As a result, the positioning reference portions 5*a*, 5*b*, 5*c* of the funnel 1 are formed at distances from the maximum profile line 4 toward the narrow open end 3, and in addition, the positioning reference surfaces 6*a*, 6*b*, 6*c* are formed at positions distanced inwardly from the maximum profile line 4 toward the axis.

Figure 4:
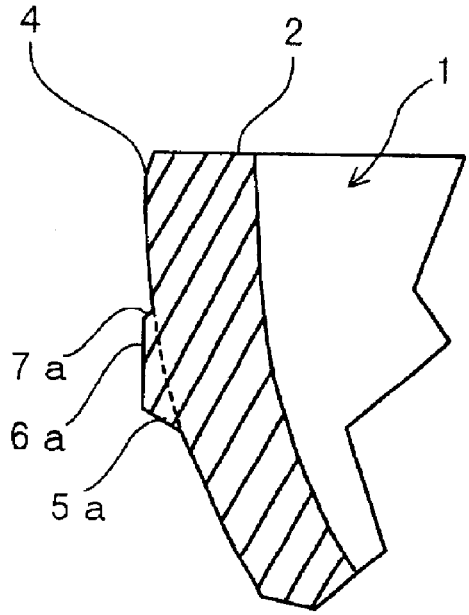
FIG. 4 is a section view of essential part along the line A-A1 of FIG. 1, showing a positioning reference portion of another funnel for cathode ray tube according to the present invention.

In the above-mentioned embodiment, as shown in FIG. 2, the positioning reference portions 5*a*, 5*b*, 5*c* are formed so that the sides of the upper end edges 7*a*, 7*b*, 7*c* thereof do not project from the outer wall surfaces of the funnel 1, however, as shown in FIG. 4, it is also possible to have configuration that the positioning reference portions 5*a*, 5*b*, 5*c* of the funnel 1 are formed at positions distanced from the maximum profile line 4 toward the narrow open end 3, and the upper end edges 7*a*, 7*b*, 7*c* of the positioning reference portions 5*a*, 5*b*, 5*c* are also projected as same as the lower end sides thereof.

Figure 5:
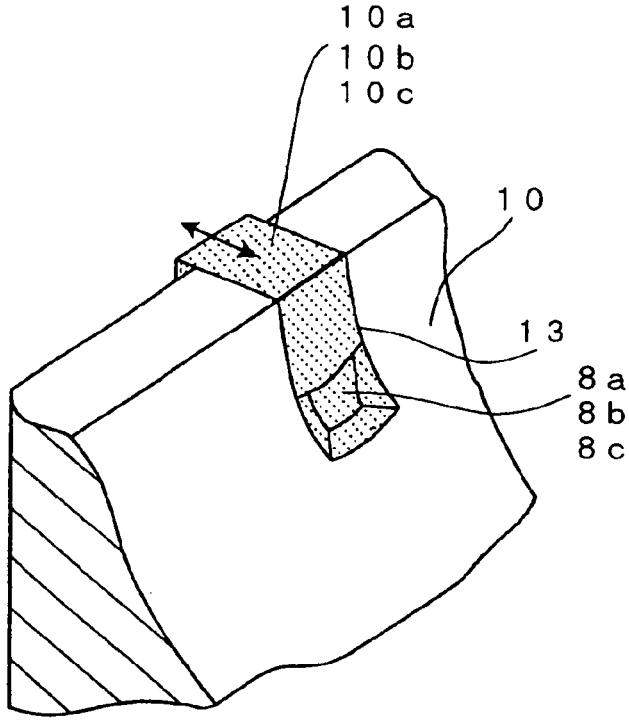
FIG. 5 is a perspective view of essential part of a bottom mold configuration used for press molding of another funnel for cathode ray tube according to the present invention.

In the above case, however, in order to form the molding surfaces for the positioning reference portions 5*a*, 5*b*, 5*c* in the bottom mold 10, for example, the configuration as shown in FIG. 5 is employed. That is, at the positions where the molding surfaces for the positioning reference portions 5*a*, 5*b*, 5*c* are to be formed, slits 13 extending from the upper end surface of the bottom mold 10 are formed, and sliding pieces 10*a*, 10*b*, 10*c* configured to be slidable in the direction of arrow with respect to the bottom mold 10 and formed with molding surfaces 8*a*, 8*b*, 8*c* for forming the positioning reference portions 5*a*, 5*b*, 5*c* are fitted into these slits 13.

After making the funnel 1 by press molding with the use of the bottom mold 10 having these sliding pieces 10*a*, 10*b*, 10*c* fitted therein, the shell mold 11 and the plunger mold 12, the plunger mold 12 is moved up, then the shell mold 11 is removed, and the sliding pieces 1*a*, 10*b*, 10*c* are moved outwardly in the direction of arrow, to thereby remove the press molded funnel 1 from the bottom mold 10.

Also in the present embodiment, since the positioning reference portions 5*a*, 5*b*, 5*c* are formed in the stage where the temperature of the glass is not decreased before the molten glass gob has extended by pressing to reach the upper wide open end 2 during press molding, it is possible to suppress occurrences of molding defects such as not-filled, wrinkling and chipping as described above.

Moreover, according to the present embodiment, in order to adjust the positions of the positioning reference portions 5*a*, 5*b*, 5*c*, a plurality of sliding pieces having the molding surfaces 8*a*, 8*b*, 8*c* for forming the positioning reference portions 5*a*, 5*b*, 5*c* located at positions different from each other are prepared, and the positions of the positioning reference portions 5*a*, 5*b*, 5*c* may be readily adjusted by replacing these sliding pieces. Furthermore, by making fine adjustment of the fixing positions of the sliding directions of the sliding pieces 10*a*, 10*b*, 10*c*, it is also possible to adjust the positions of the reference surfaces 6*a*, 6*b*, 6*c*.

In the embodiments of the present invention, a pad-like positioning reference portion is used as an example, however, any shapes can be used as far as the reference surface of the positioning reference portion is formed at a predetermined distance from the axis of the funnel; a required area of abutment with a jig is secured; and positioning of the funnel can be properly achieved when sealing with the panel.

In addition, the number of positioning reference portion is at least 3 in total so as to secure highly accurate sealing with a panel, however, it may be more than or equal to 4 as necessary.

UTILITY IN THE INDUSTRIAL FIELD

According to the funnel for cathode ray tube of the present invention, since the positioning reference portions are formed at distances from the maximum profile line toward the narrow open end, occurrences of molding defects such as not-filled, wrinkling, chipping and the like are suppressed, so that it is possible to improve the productivity of the funnel.

Furthermore, according to the present invention, since the positioning reference surfaces are formed at positions distanced inwardly from the maximum profile line toward the axis, the amount by which the positioning reference surface projects from the outer wall of the funnel vertically and outwardly with respect to the axis of the funnel is reduced, and thus the change in wall thickness of the portion in question is relieved, presenting an excellent advantage that a funnel for cathode ray tube which will not generate a small crack can be produced.

What is claimed is:

1. A funnel for use in a cathode ray tube comprising:

a wide open end of generally rectangular shape;

a maximum profile line formed in the vicinity of the wide open end by mold matching of forming molds;

a narrow open end of generally circular shape; and a positioning reference portion disposed on an outer wall thereof used for sealing with a panel for the cathode ray tube, wherein an upper end edge of the positioning reference portion is formed at a distance from the maximum profile line toward the narrow open end, and wherein a reference surface of the positioning reference portion is formed inside the maximum profile line.

2. A funnel for use in a cathode ray tube comprising:

a wide open end of generally rectangular shape, extending horizontally;

a maximum profile line formed in the vicinity of the wide open end by mold matching of forming molds;

a narrow open end of generally circular shape; and a positioning reference portion disposed on an outer wall thereof used for sealing with a panel for the cathode ray tube, wherein an upper end edge of the positioning reference portion is formed at a distance from the maximum profile line toward the narrow open end, wherein when a distance in the vertical direction of the funnel from the maximum profile line to the upper end edge of the positioning reference portion is defined as h (mm), and when a distance in the vertical direction of the funnel from the wide open end to the narrow open end is defined as H (mm), $h \leqq 0.2H$ is satisfied, and, wherein a reference surface of the positioning reference portion is formed inside the maximum profile line.

3. A funnel for use in a cathode ray tube comprising:

an upper end having a wide and rectangular opening, extending horizontally;

a lower end having a narrow and circular opening, opposing the upper end;

an outer wall extending between the upper end and the lower end, communicating between the wide and rectangular opening and the narrow and circular opening, wherein the outer wall is formed to have a maximum profile line at the vicinity of the upper end; and a positioning reference portion provided below the maximum profile line on the outer wall, wherein the positioning reference portion is used for sealing a cathode ray tube panel, and wherein the position reference portion is formed not to project its upper end edge from the outer wall surface.

4. A funnel for cathode ray tube comprising:

an upper end having a wide and rectangular opening, extending horizontally;

a lower end having a narrow and circular opening, opposing the upper end;

an outer wall extending between the upper end and the lower end, communicating between the wide and rectangular opening and the narrow and circular opening, wherein the outer wall is formed to have a maximum profile line at the vicinity of the upper end; and a positioning reference portion provided slightly below the maximum profile line on the outer wall, positioned inside the maximum profile line, the positioning reference portion being used for sealing a cathode ray tube panel.

* * * * *